US009119462B2

(12) United States Patent
Gliemroth et al.

(10) Patent No.: US 9,119,462 B2
(45) Date of Patent: Sep. 1, 2015

(54) ORAL CLEANING IMPLEMENT HAVING A PLASTIC STAPLE COMPRISING A CAVITY

(75) Inventors: Frank Roland Gliemroth, Schwalbach (DE); Nadine Rosenberger, Tecklenburg (DE); Michael Machlitt, Schwalbach (DE); Olena Uhl, Frankfurt am Main (DE); Jochen Kawerau, Kronberg/Taunus (DE)

(73) Assignee: BRAUN GMBH, Kronberg (DE)

( * ) Notice: Subject to any disclaimer, the term of this patent is extended or adjusted under 35 U.S.C. 154(b) by 303 days.

(21) Appl. No.: 13/555,349

(22) Filed: Jul. 23, 2012

(65) Prior Publication Data

US 2013/0019426 A1 Jan. 24, 2013

(30) Foreign Application Priority Data

Jul. 23, 2011 (EP) ..... 11006046
Jul. 23, 2012 (EP) ..... 12177424

(51) Int. Cl.
*A46B 3/16* (2006.01)
*A46D 3/04* (2006.01)

(52) U.S. Cl.
CPC ..... *A46B 3/16* (2013.01); *A46B 2200/1066* (2013.01); *A46D 3/042* (2013.01)

(58) Field of Classification Search
USPC ..... 15/167.1, 190, 193, 195, 199
See application file for complete search history.

(56) References Cited

U.S. PATENT DOCUMENTS

| | | | |
|---|---|---|---|
| 1,055,607 | A | 3/1913 | Chandler |
| 2,409,490 | A | 10/1946 | Jobst |
| 5,490,529 | A | 2/1996 | Fitjer |
| 5,590,438 | A | 1/1997 | Chen et al. |
| 5,687,446 | A | 11/1997 | Chen et al. |
| 5,724,697 | A | 3/1998 | Klee et al. |
| 5,740,579 | A | 4/1998 | Fassler |
| 5,823,633 | A | 10/1998 | Weihrauch |
| 6,309,125 | B1 | 10/2001 | Peters |
| 6,618,893 | B1 | 9/2003 | Wang |
| 7,174,596 | B2 | 2/2007 | Fischer et al. |
| 7,354,112 | B2 | 4/2008 | Fischer et al. |
| 7,445,295 | B2 | 11/2008 | Fischer et al. |
| 7,458,647 | B2 | 12/2008 | Fischer et al. |
| 7,520,571 | B2 | 4/2009 | Fischer et al. |
| 7,690,733 | B2 | 4/2010 | Spitale et al. |
| 7,988,238 | B2 | 8/2011 | Fischer et al. |
| 2001/0020315 | A1 | 9/2001 | Lallement |
| 2003/0041402 | A1 | 3/2003 | Stein et al. |
| 2005/0015909 | A1 | 1/2005 | Spitale et al. |
| 2005/0041874 | A1 | 2/2005 | Langelaar et al. |

(Continued)

FOREIGN PATENT DOCUMENTS

| | | |
|---|---|---|
| DE | 581 576 C | 7/1933 |
| DE | 16 57 307 | 2/1971 |

(Continued)

OTHER PUBLICATIONS

European Search Report for Z-8598FQ dated Dec. 19, 2011.

*Primary Examiner* — Shay Karls
(74) *Attorney, Agent, or Firm* — Vladimir Vitenberg

(57) ABSTRACT

An oral cleaning implement can be produced by stapling at least one bristle filament and/or one or more bristle tufts into a tuft hole. Staples used for said stapling may be produced from plastic material by extrusion technology. Said staples may have a cavity formed along one of its axis and optional one or more recesses at its side faces.

12 Claims, 12 Drawing Sheets

(56) References Cited

U.S. PATENT DOCUMENTS

| | | | | |
|---|---|---|---|---|
| 2005/0146200 | A1 | 7/2005 | Stein et al. | |
| 2006/0242779 | A1 | 11/2006 | Milheim et al. | |
| 2008/0060668 | A1 | 3/2008 | Legassie | |
| 2008/0104785 | A1 | 5/2008 | Robinson | |
| 2009/0229064 | A1 | 9/2009 | Robinson | |
| 2011/0146009 | A1 * | 6/2011 | Marsh et al. | 15/21.1 |

FOREIGN PATENT DOCUMENTS

| | | | |
|---|---|---|---|
| DE | 35 01 098 | | 7/1986 |
| DE | 40 05 276 | A1 | 8/1991 |
| DE | 42 24 903 | C2 | 3/1996 |
| DE | 195 19 291 | A1 | 11/1996 |
| DE | 195 45 030 | | 6/1997 |
| DE | 198 57 032 | | 7/1999 |
| DE | 102 21 786 | | 11/2003 |
| DE | 10 2008 060 696 | | 6/2010 |
| EP | 0 956 304 | A2 | 3/1999 |
| EP | 0 840 561 | B1 | 5/2002 |
| EP | 1 593 321 | A1 | 11/2005 |
| EP | 2 060 201 | | 5/2009 |
| EP | 1 088 495 | A1 | 4/2010 |
| FR | 2805977 | | 9/2001 |
| FR | 2905572 | | 3/2008 |
| GB | 2 433 970 | A | 7/2007 |
| GB | 2 476 282 | A | 6/2011 |
| JP | 9-313252 | A | 12/1997 |
| JP | 9313252 | A | 12/1997 |
| JP | 2001178537 | A | 7/2001 |
| JP | 2001309818 | A | 11/2001 |
| JP | 2006297145 | | 2/2004 |
| JP | 2004121823 | | 4/2004 |
| JP | 2005518829 | | 6/2005 |
| JP | 2008-29469 | A | 2/2008 |
| JP | 4094644 | B | 6/2008 |
| JP | 4335686 | B | 9/2009 |
| JP | 2005516495 | | 10/2011 |
| WO | WO 95/30350 | | 11/1995 |
| WO | WO 97/46136 | | 12/1997 |
| WO | WO 98/05238 | A1 | 2/1998 |
| WO | WO 98/43514 | A1 | 10/1998 |
| WO | WO 03/022097 | | 3/2003 |
| WO | WO 03/055351 | | 7/2003 |
| WO | WO 2004/010821 | | 2/2004 |
| WO | WO 2004/080238 | | 9/2004 |
| WO | WO 2006/115963 | A2 | 11/2006 |
| WO | WO 2008/057852 | | 5/2008 |
| WO | WO 2011/002460 | | 1/2011 |

* cited by examiner

ORAL CLEANING IMPLEMENT HAVING A PLASTIC STAPLE COMPRISING A CAVITY

CROSS REFERENCE TO RELATED APPLICATIONS

This application claims the benefit of European Patent Convention Application No. 11006046.4 filed Jul. 23, 2011, the substance of which is incorporated by reference in its entirety herein.

FIELD OF THE INVENTION

The present disclosure is concerned with an oral cleaning implement having at least one bristle filament and/or one or more bristle tufts being stapled into the oral cleaning implement using a staple suitable for stapling the at least one bristle filament and/or one or more bristle tufts into a receptacle or a tuft hole of an oral cleaning implement. The staple includes at least one cavity. In particular, the staple is suitable to staple bristle filament bundles into a brush head, in particular into a toothbrush head. It is further disclosed to produce staples having at least one cavity and/or one or more recesses by extrusion technology. The oral cleaning implement might be a toothbrush or a toothbrush head, such as a disposable replacement brush head, in which at least one filament and/or one or more bristle tufts are stapled by such a staple. It is another aspect to disclose a method of production of said oral cleaning implement.

BACKGROUND OF THE INVENTION

A conventional brush, in particular a toothbrush, comprises a brush head and a shaft or a handle. Individual bristle filaments are grouped together to form bristle bundles or bristle tufts which are arranged in a predefined geometry onto the brush head. In some cases, the bristle tufts are stapled by stapling means into blind ended tuft holes. The tuft holes may be directly formed into the brush head and/or the tuft holes are part of a separate bristle carrier which can be included into the brush head. For stapling, the tufts are looped or bent in a U-shaped configuration around a stapling means, for example, an anchor wire, an anchor or a staple. Known staples have a rectangular shape with variations made from metals and metal alloys containing nickel, copper, zinc and/or silver.

It is a desire to provide an alternative staple for bristle tufting which shows high retention strength and/or which is recyclable. Further the staple should be usable in tuft holes having a small spacing from each other.

SUMMARY OF THE INVENTION

In one embodiment, an oral cleaning implement is provided. The oral cleaning implement includes a head portion having one or more cleaning elements. The one or more cleaning elements include at least one filament tuft having a plurality of filaments and wherein the at least one filament tuft is fastened into a tuft hole with a staple being elongated in one dimension having a longitudinal axis and including a cavity having an identical, similar or different shape compared to the shape of the staple. The cavity is arranged along the longitudinal axis, in parallel to the longitudinal axis, perpendicularly to the longitudinal axis or inclined to the longitudinal axis, wherein the staple is compressible crosswise to the longitudinal axis by deforming the cavity and wherein the at least one filament tuft is bent to the staple in a U-shape.

In another embodiment, there is provided a method for production of such a staple comprising the steps of producing a staple-strand using extrusion technology and after extrusion cutting the strand into a plurality of staples having a predefined length.

In another embodiment, there is provided a method for stapling filaments into an oral cleaning implement comprising bending at least one filament around a staple as disclosed herein, compressing the staple in at least one compression direction and driving the compressed staple together with the bent filament(s) into the tuft hole.

These and other features, aspects and advantages of specific embodiments will become evident to those skilled in the art from a reading of the present disclosure.

BRIEF DESCRIPTION OF DRAWINGS

The embodiments set forth in the drawings are illustrative in nature and not intended to limit the invention defined by the claims. The following detailed description of the illustrative embodiments can be understood when read in conjunction with the following drawings, where like structure is indicated with like reference numerals and in which:

FIG. 1 shows two examples of a staple according to embodiments shown and described herein:

FIG. 2 shows an example of a staple according to embodiments shown and described herein:

FIG. 3 shows an example of a staple according to embodiments shown and described herein:

FIG. 5 shows an example of a staple according to embodiments shown and described herein, wherein the cavity 20 is arranged along the longitudinal axis 24:

FIG. 6 shows several shapes of staples 10 as disclosed herein comprising several shapes of cavities 20:

FIG. 8 shows examples of staples 10 which narrow towards at least one side:

DETAILED DESCRIPTION OF THE INVENTION

Figure 1A:
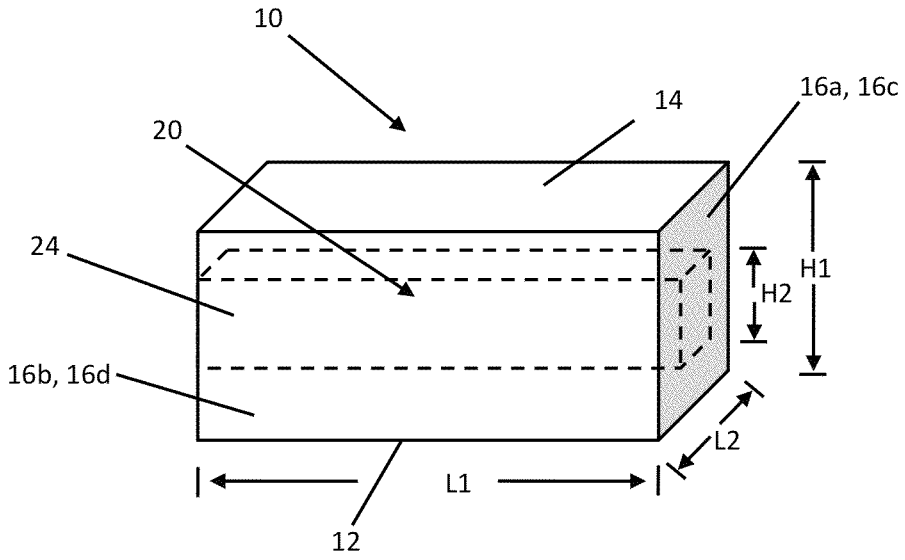
FIG. 1A shows a perspective view of a staple being a rectangular cube.

The following text sets forth a broad description of numerous different embodiments of the present disclosure. The description is to be construed as exemplary only and does not describe every possible embodiment since describing every possible embodiment would be impractical, if not impossible. It will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims. All publications and patents cited herein are incorporated herein by reference.

The staple in accordance with at least one aspect of the present disclosure may be suitable for stapling bristles into a receptacle, in particular into a tuft hole. "Receptacle" as used herein shall mean any hollow or depression which may be suitable to house at least one filament or at least one cleaning element. In one embodiment, the receptacle may be a "tuft hole" meaning that the receptacle may be suitable to house a plurality of filaments or cleaning elements. Such receptacle may be provided by a brush head and/or a bristle carrier of an oral care implement.

The staple may be elongated in one dimension having at least one axis of symmetry in this dimension. "Elongated" as used herein shall mean that the dimension of the staple in one direction may be greater than in all other directions. The "longitudinal axis" as used herein shall be located at the axis of symmetry of the staple along said elongated dimension. The staple comprises at least a cavity having an identical, similar or different shape compared to the shape of the staple. The term "cavity" as used herein shall mean every hole or hollow of every shape which is filled not by solid matter, but by gas. The solid matter encircles or surrounds the cavity at least partially. The solid matter may encircle or surround the cavity completely except of one opening at the surface of the staple. Alternatively, the solid matter may encircle or surround the cavity except of two opening at at least one surface area of the staple. The two openings may be located substantially opposite to each other. That means the two opening may be located at surface areas of the staple which are located substantially opposite to each other. Alternatively, the solid matter may encircle the cavity completely. The solid matter may be the material from which the staple is produced. In addition or alternatively, the gas may be air. The staple may be compressible in at least one compression direction. "Compressible" as used herein shall mean that the staple is deformable and/or that the volume of the staple can be reduced as a result of external pressure. The deformation and/or the reduction of the volume of the staple is due to a deformation and/or reduction of the volume of the cavity. The compression may be at least about 5%. Alternatively, the compression may be at least about 10% or the compression may be at least about 15% or the compression may be at least about 20%. "Compression direction" as used herein shall be the direction in which the volume of the staple can be reduced as a result of the external pressure or force applied. External force and compression direction are substantially aligned. The compression direction may be for example crosswise to the longitudinal axis of the staple or perpendicular or upright to the longitudinal axis of the staple.

The staple may be suitable to staple bristle tufts into a tuft hole. The term "to staple" as used herein shall mean any type of fastening or locking the bristle tufts into position in the tuft hole. Due to the space of the cavity and its smart shape and geometry the shape of the staple can be altered through the punching of the staple into the tuft hole. Thereby the insertion of the staple becomes easier because the volume or dimension of the staple can be temporarily reduced. After insertion the staple reshapes as much as possible, wherein the reshaping may be limited by the receptacle dimension. Thus, the shape alteration of the staple leads to a mechanical clawing or clamping mechanism inside the receptacle.

The cavity may be a blind hole having at least one opening on a surface of the staple. Alternatively, the cavity may be a through-hole having two openings on at least one surface or surface area of the staple. Having a through-hole may mean that the cavity may extend along the whole staple. The openings of the cavity being a through-hole may be located everywhere on the surface of the staple. For example, the staple may have a regular or irregular surface having faces. Then, the opening(s) of the through-hole may be on a face. If the through-hole is a straight hole, the openings of the trough-hole may be located substantially opposite to each other. In addition or alternatively, the opening(s) of the through-hole may be on an edge and/or on a joint. In another embodiment, the cavity may be a groove-hole having three openings on the surfaces of the staple. Said openings being located at three surfaces may be combined to one opening which can be described as a slit or a groove or a rip. All features described for blind-holes or through-holes are also applicable to groove-holes.

Only one cavity may be arranged inside the staple or two or more cavities may be arranged inside the staple. One or more cavities, blind holes or through-holes may be arranged along the longitudinal axis of the staple. In addition or alternatively, one or more cavities, blind holes or through-holes may be arranged in parallel to the longitudinal axis of the staple. In addition or alternatively, one or more cavities, blind holes or through-holes may be arranged perpendicularly to the longitudinal axis of the staple. In addition or alternatively, one or more cavities, blind holes or through-holes may be arranged inclined to the longitudinal axis of the staple. "Inclined to the longitudinal axis" as used herein shall mean that an angle between a center line of the cavity, blind hole or through-hole and the longitudinal axis of the staple may be greater than 0°. Alternatively the angle may be greater than about 10° or greater than about 20° or greater than about 30° or greater than about 50° or greater than about 70°.

For example, more than one cavity, blind hole and/or through-hole may be arranged perpendicularly to the longitudinal axis of the staple. For example one cavity, blind-hole and/or through-hole may be arranged at both ends of the longitudinal axis. In another embodiment, the cavity, blind hole and/or through-hole may be arranged along the longitudinal axis of the staple and/or it may be arranged above said axis or below said axis. If more than one cavities, blind-holes and/or through-holes shall be arranged, one may be located on the longitudinal axis and one or more below said axis or one may be located on the longitudinal axis and one or more above said axis. In addition or alternatively, one or more cavities, blind-holes and/or through-holes may be located above the longitudinal axis and one or more below. In addition or alternatively, one cavity, blind-hole and/or through-hole may be located on the longitudinal axis and one or more through-holes may be located above the longitudinal axis and one or more through-holes below the longitudinal axis. In one embodiment a staple may comprise one or more cavities, blind-holes and/or through-holes. Every staple as described herein can be combined with every cavity, blind-hole, through-hole and/or groove-hole as described herein.

The opening(s) of the cavity on the surface of the staple is limited due to stability reasons. The larger the opening the better is the deformation of the staple. However, a larger opening reduced the stability of staple and a minimum stability is needed to drive the staple into the receptacle. The opening of the cavity on the surface area of the staple may be in the range of about 5% to about 50% of said surface area. To calculate the surface area only the area or side face in calculated which comprises the opening. The opening may be in the range of about 10% to about 45% of said surface area of the staple, or alternatively the opening may be in the range of about 20% to about 40% of said surface area of the staple onto the opening appears.

For example in one embodiment, staples which are shaped as a polyhedron can be used. A polyhedron shall be understood as a geometric three-dimensional body having flat faces and straight edges. A staple having six faces and being a rectangular cube shall be described as an example. FIG. 1A shows such a staple 10 as a perspective view. A first face 12 suitable to be inserted into a receptacle of a tuft hole is shown as the base face of the staple. The first face 12 may comprise at least one longer edge having a length L1. The first face 12 may further comprise at least one smaller edge having a length L2. In addition or alternatively, at least two of the edges of the first face 12 being parallel to each other may show the same length, e.g. L1 or L2. In a further embodiment, two pairs of edges of the first face 12 may show the same length L1 and L2, respectively. In another embodiment, all edges of the first face 12 may show the same length L. In one embodiment, L1 may be smaller than L2. The geometric dimension of the staple, for example L1 and L2, depend on the geometric dimension of the receptacle in which the staple shall be stapled. In an example embodiment, in one dimension the staple may be at least 0.1 mm larger than the diameter of the receptacle, or in one dimension the staple may be at least 0.15 mm larger than the diameter of the receptacle or in one dimension the staple may be at least 0.2 mm larger than the diameter of the receptacle. For example a suitable receptacle may be a circular hole having a diameter in the range of about 1 mm to about 4 mm, or in the range of about 1 to about 3 mm, or in the range of about 1 to about 2.5 mm or in the range of about 1.4 to about 2.0 mm.

In parallel to said first face 12 a second face 14 may be arranged which is spaced from the first face 12 by a height H1. In this embodiment, first face 12 and second face 14 are arranged parallel to each other. First face 12 and second face 14 are shown as a rectangular square, so that four lateral faces 16*a*, 16*b*, 16*c*, 16*d* form the lateral outline of the staple 10. However, other embodiments are also possible, wherein first and second faces 12, 14 are not in parallel to each other or wherein the second face 14 may be shifted laterally with respect to the first face 12. Another alternative may be that the second face 14 is turned with respect to the first face 12 so that one edge of the second face 14 is located in a plumb-line to one vertex of the first face 12. In addition or alternatively, a combination of these arrangements can be used to form the staple 10 in further suitable embodiments.

The maximum height H1 of the staple may be limited by the depth of the tuft hole and a reasonable overhang. The height H1 of the staple 10 may be also smaller than the depth of the respective tuft hole. The depth of the receptacle depends on the material in which the receptacle is formed. Suitable receptacles for toothbrushes may show a depth in the range of about 0.5 mm to about 2.5 mm or in the range of about 0.8 to about 2.0 mm or in the range of about 1 to about 1.5 mm. The higher the height H1 of the staple, the higher is the retention strength of the staple.

The lateral surface of the staple 10 as described herein in FIG. 1A as an example comprises four side faces 16*a* to 16*d*. Said staple 10 may comprise as a cavity a through-hole 20 which lances the staple body 10 substantially in parallel to the longitudinal axis 24. The through-hole 20 comprises a height H2 which is smaller than the height H1 of the staple 10.

In order to maintain stability of a staple, a cavity, blind-hole, through-hole and/or groove-hole may have a maximal height. Said height may be measured substantial perpendicular to the longitudinal axis of the cavity, blind-hole and/or through-hole. Thus, in addition or alternatively, in one embodiment, the height of the through-hole may be in the range of about 10% to about 90% of the total height of the staple. In another embodiment, the height of the through-hole may be in the range of about 10% to about 70% of the total height of the staple. In another embodiment, the height of the through-hole may be in the range of about 20% to about 50% of the total height of the staple. In another embodiment, the height of the through-hole may be in the range of about 30% to about 40% of the total height of the staple. The larger the cavity, blind-hole and/or through-hole 20 of the staple, the easier is the compression or deformation of the staple during stapling. The smaller the cavity, blind-hole and/or through-hole 20 of the staple, the stiffer is the staple.

Figure 2A:
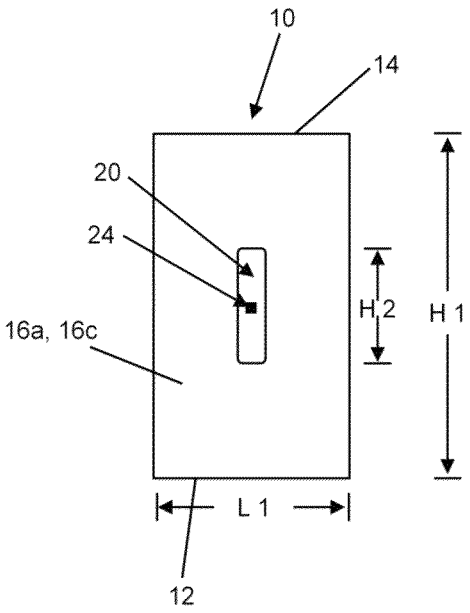
FIG. 2A shows a side view onto a lateral side 16*a*, 16*c* having an opening of the cavity 20.
Figure 2B:
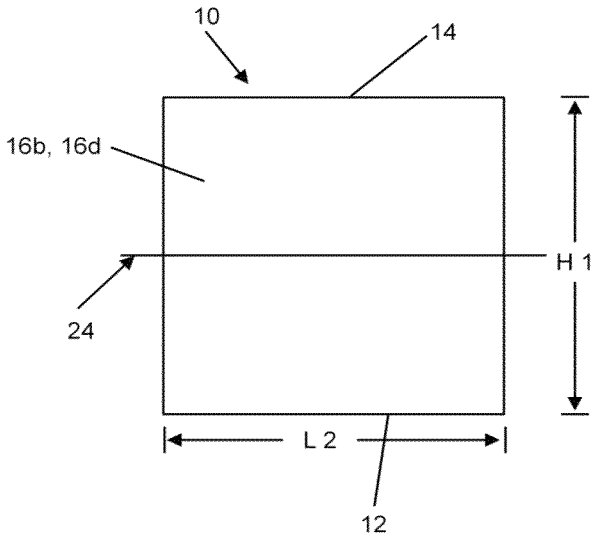
FIG. 2B shows a side view onto a lateral side 16*b*, 16*d* not having an opening of the cavity 20.
Figure 2C:
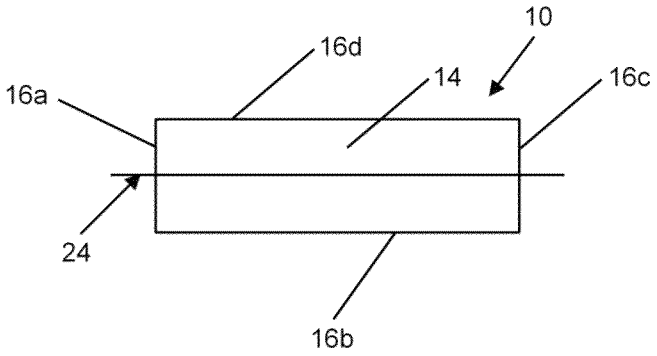
FIG. 2C shows a top view of the staple 10.

FIG. 2 shows side views of the staple 10 shown in FIG. 1A. The rectangular staple 10 having a through-hole 20 as a cavity is shown in side view from a lateral side 16*a*, 16*c* (FIG. 2A). Both lateral sides 16*a*, 16*c* comprise an opening of the through-hole 20. In FIG. 2B the staple 10 is turned by 90 degree with respect to the side view shown in FIG. 2A. Thus, FIG. 2B shows a side view of a staple 10 facing a lateral side 16*b* or 16*d* which do not comprise an opening of the through-hole 20. FIG. 2C shows a top view of the staple 10. In one embodiment, the staple 10 shows a height H1 which is larger than a height H2 of the through-hole 20.

Figure 1B:
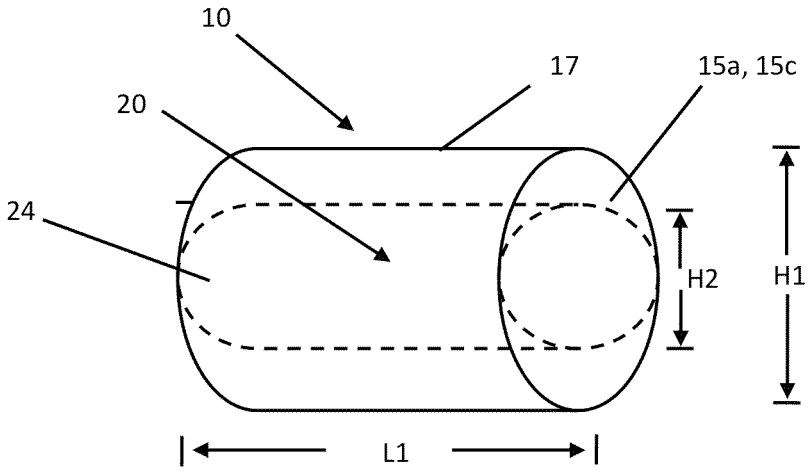
FIG. 1B shows a perspective view of a staple being a cylinder.

In another embodiment, the staple 10 may be a cylinder having a round, elliptic or irregular base. FIG. 1B shows a cylinder having a round base 15*a* as an example. The round base 15*a* comprises a diameter H1. A top 15*c* is arranged substantial in parallel to the base 15*a* spaced by a length L1. A shell 17 is arranged between the base 15*a* and the top 15*c*. In this embodiment, the cylinder 10 may comprise one or more cavities, blind-holes, through-holes or groove-holes. A through-hole 20 is shown as an example. Said through-hole 20 may be arranged substantial in parallel to a longitudinal axis 24 of the cylinder. Thus, the staple 10 may have openings of the through-hole 20 at both the base 15*a* and the top 15*c*. The through-hole 20 may have a diameter H2, which may be at least smaller than the diameter H1 of the base 15*a* and the top 15*c*.

In addition or alternatively, a staple having a polygonal shape as described herein may have rounded edges so that there is a smooth transition from one face to the adjacent face. Rounded edges likely reduce the risk to cut the filaments which are bent around the staple, while they are more complicated to realize. On the other hand, sharp edges likely ease the insertion of the staple into the receptacles or the tuft holes, because a staple having sharp edges can be driven more easily into the tuft hole wall, while they increase the risk to cut the filaments. Thus, the edges have to be sharp enough to be driven into the side walls of the tuft hole and smooth enough not to cut the bent filaments.

Figure 3A:
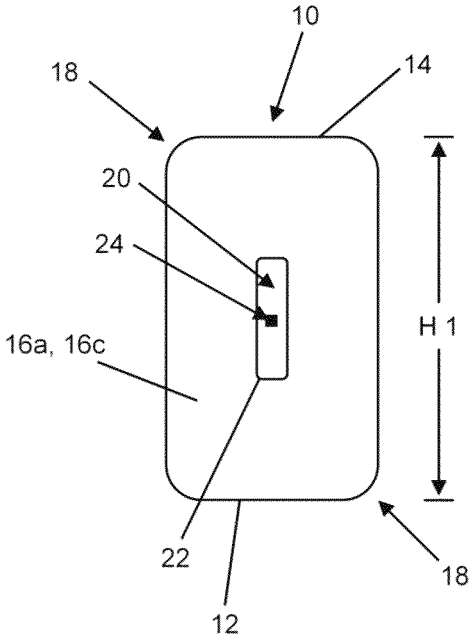
FIG. 3A shows a side view onto a lateral side 16*a*, 16*c* having an opening of the cavity 20.
Figure 3B:
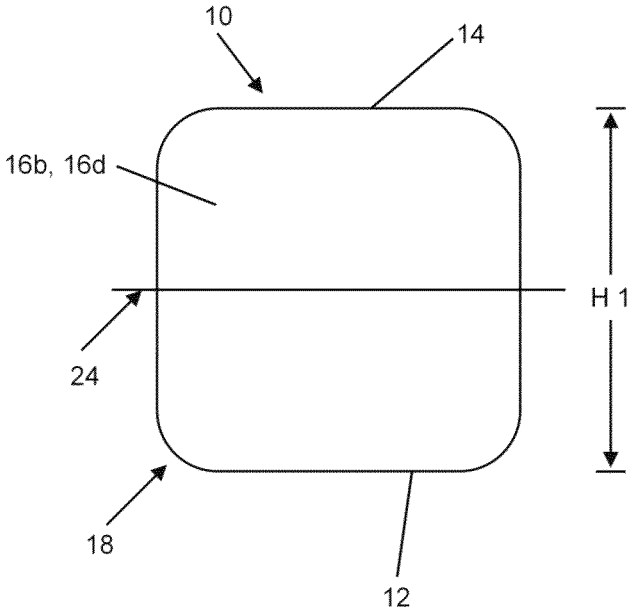
FIG. 3B shows a side view onto a lateral side 16*b*, 16*d* not having an opening of the cavity 20.
Figure 3C:
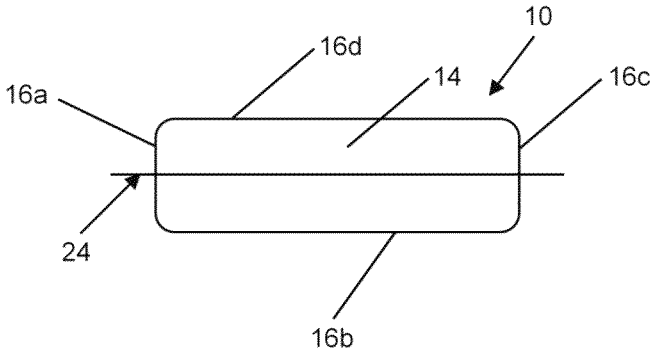
FIG. 3C shows a top view of the staple 10.

In FIG. 3, a further example embodiment of a staple 10 is shown. Said staple 10 comprises rounded edges 18 and comprises a blind-hole or a through-hole or a groove-hole as a cavity. A blind-hole or a through-hole is shown because the arrangement of the cavity inside the staple can be seen easier, if at least one opening is present at the outer surface of the staple 10. However closed cavities can be used as well as groove-holes. All features of the staple 10 disclosed in the embodiment of FIGS. 1 and 2, whether described individually or in combination, are also applicable to the embodiment shown in FIG. 3. The same reference signs are used for the same features as used before in FIGS. 1 and 2. FIG. 3A shows a side view onto the faces 16*a*, 16*c* comprising each an opening of the through-hole 20. If the cavity is a blind-hole only one of the lateral sides 16*a*, 16*c* comprises an opening of the blind-hole 20. In FIG. 3B, the staple 10 is turned by 90 degree with respect to the side view shown in FIG. 3A. Thus, FIG. 3B shows a side view of a staple 10 facing a lateral side 16*b* or 16*d* which does not comprise an opening of the blind-hole or the through-hole 20. FIG. 3C shows a top view of the staple 10 having rounded edges 18.

Figure 4A:
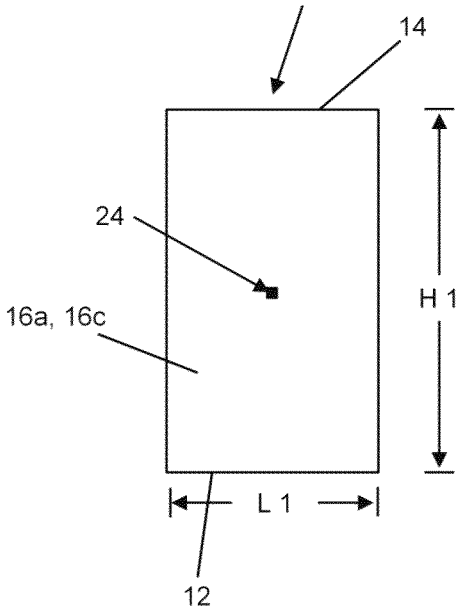
FIGS. 4A and B show side views onto the lateral sides 16*a* to 16*d* which do not comprise an opening of the cavity 20.
Figure 4B:
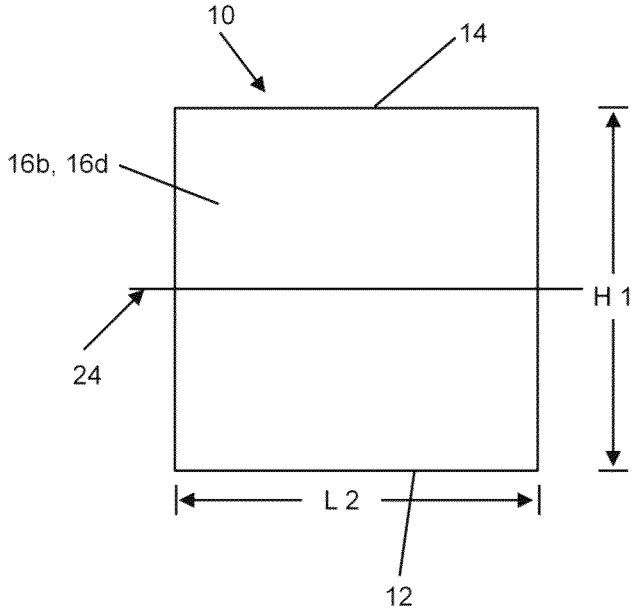
FIG. 4 shows an example of a staple according to embodiments shown and described herein, wherein the cavity 20 is arranged perpendicularly to the longitudinal axis 24.
FIG. 4C shows a top view of the staple 10 comprising two openings of the cavity 20.
Figure 4C:
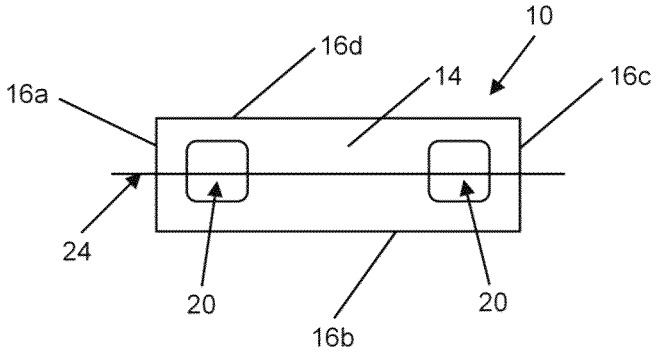

In another example embodiment, disclosed herein, the cavity may be arranged substantial perpendicularly to the longitudinal axis 24. An example of such a staple 10 is shown in FIG. 4. A blind-hole or a through-hole is shown because the arrangement of the cavity inside the staple can be seen easier, if at least one opening is present at the outer surface of the staple 10. However closed cavities can be used as well as groove-holes. All features of the staple 10 disclosed in the embodiments shown before, whether described individually or in combination, are also applicable to the embodiment shown in FIG. 4. The same reference signs are used for the same features as used before. FIG. 4A is a side view onto the faces 16*a*, 16*c*. In FIG. 4B the staple 10 is turned by 90 degree with respect to the side view shown in FIG. 4A. Thus, FIG. 4B shows a side view of the staple 10 facing a lateral side 16*b* or 16*d*. All lateral sides 16*a*, 16*b*, 16*c*, 16*d* do not comprise an opening of the through-hole 20. FIG. 4C shows a top view of the staple 10, wherein two blind-holes or through-holes 20 are arranged, each being arranged substantial perpendicularly to the longitudinal axis 24. In this embodiment, the blind-holes or through-holes 20 are arranged near to the lateral faces 16*a*, 16*c*. Each cavity 20 lances the staple 10 one twice so that the first face 12 and/or the second face 14 comprise openings of the cavity 20.

Figure 5A:
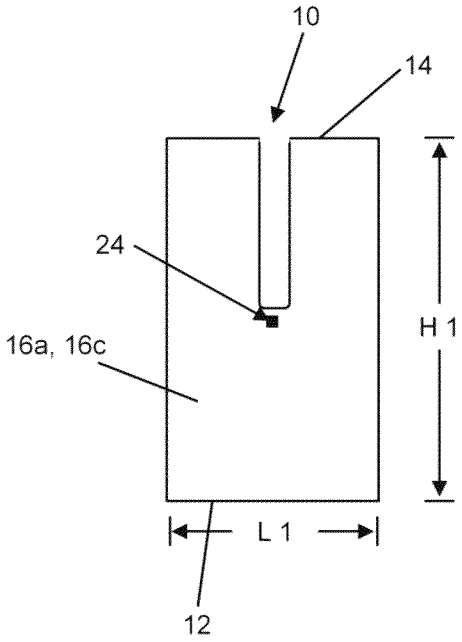
FIG. 5A shows a side view onto a lateral side 16*a*, 16*c* having an opening of the cavity 20.
Figure 5B:
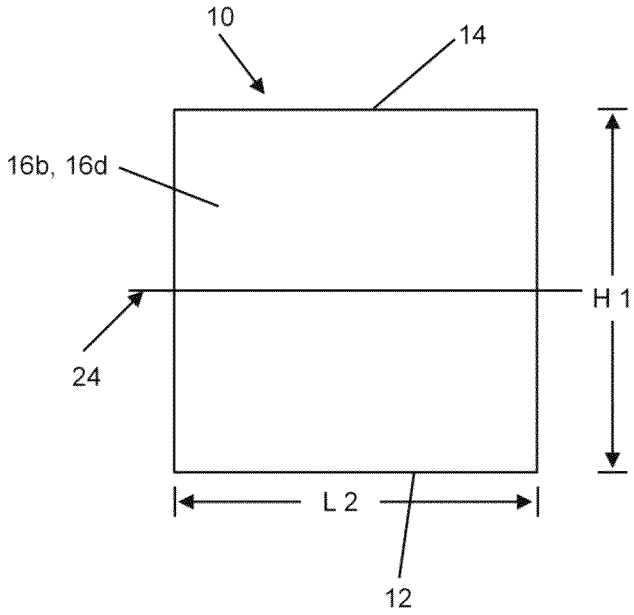
FIG. 5B shows a side view onto a lateral side 16*b*, 16*d* not having an opening of the cavity 20.
Figure 5C:
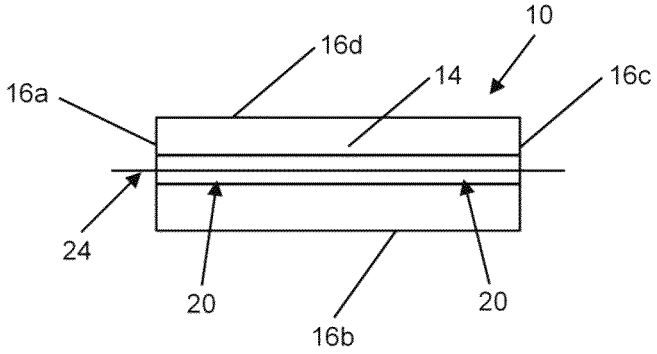
FIG. 5C shows a top view of the staple 10 comprising an opening of the cavity 20.

In another example embodiment, disclosed herein, the cavity may be arranged substantial along the longitudinal axis 24 and may show openings at three sides. An example of such a staple 10 is shown in FIG. 5. Such a groove-hole may be present as a cut from each side of the staple surface. On or more groove-holes can be arranged in a staple 10. All features of the staple 10 disclosed in the embodiments shown before, whether described individually or in combination, are also applicable to the embodiment shown in FIG. 5. The same reference signs are used for the same features as used before. FIG. 5A is a side view onto the faces 16*a*, 16*c*. Both lateral sides 16*a*, 16*c* comprise an opening of the groove-hole 20. In FIG. 5B the staple 10 is turned by 90 degree with respect to the side view shown in FIG. 5A. Thus, FIG. 5B shows a side view of the staple 10 facing a lateral side 16*b* or 16*d* which do not comprise an opening of the groove-hole 20. FIG. 5C shows a top view of the staple 10, wherein the third opening of the groove-hole 20 is arranged along the longitudinal axis 24. The depth of the groove-hole 20 corresponds to the height H2 of a blind-hole or a through-hole.

The cavities, blind-holes and/or through-hole and/or groove-holes as described herein comprise an outline or surface or shape. Said shape may be identical, similar or different to the overall shape of the staple in which the cavity, blind-hole, through-hole and/or groove-hole may be arranged. Every staple described herein can be combined with every cavity, blind-hole and/or through-hole and/or groove-hole described herein. For example round and/or elliptic cavities, blind-holes and/or through-holes can be arranged in a staple being a polyhedron, for instance a cubic or a rectangular. In addition or alternatively, round and/or elliptic cavities, blind-holes and/or through-holes may be arranged in a cylindrical staple having round, elliptic or irregular bases. In another embodiment, a polyhedral cavities, blind-holes and/or through-hole may be arranged in a staple being a polyhedron, for example a cubic or rectangular. In another embodiment, a polyhedral cavities, blind-holes and/or through-hole may be arranged in a cylindrical staple having round, elliptic or irregular bases. Further combination may be also possible such as irregular cavities, blind-holes and/or through-holes in staples having an irregular shape.

Limitation for the shape and/or the size of the cavity may be the shape and/or size of the staple. The overall shape and/or size of the cavity should be adapted to the overall shape and/or size of the staple such that the staple shows the required stability for insertion into tuft holes. That means the wall thickness of the staple in the area of the cavity, blind-hole, through-hole and/or groove-hole may be thick enough to resist to the forces needed during the stapling process. In one embodiment, the wall thickness of the staple in the area of the cavity, blind-hole, through-hole and/or groove-hole may be smaller than the minimum thickness to resist the stapling forces. In this embodiment, one or more side walls of the cavity may be destroyed and openings are formed. If the wall thickness of the staple is smaller the stability of the staple is reduced. If the wall thickness is larger, the flexibility of the staple is reduced. The staples described herein are rigid enough to be driven into a tuft hole, but they are also flexible enough to be deformed by compressing the cavity.

Figure 6A:
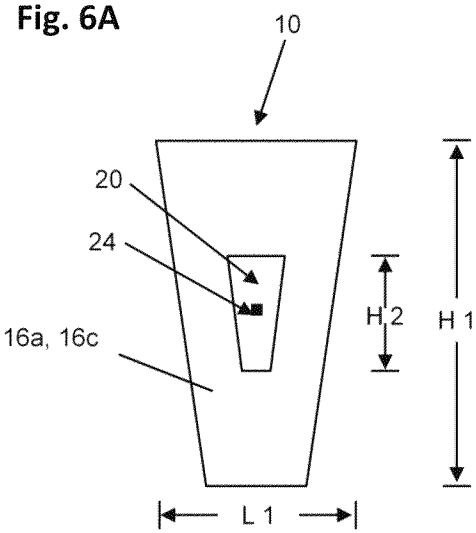
FIG. 6A shows a trapezoidal staple 10 comprising a trapezoidal cavity 20.
Figure 6B:
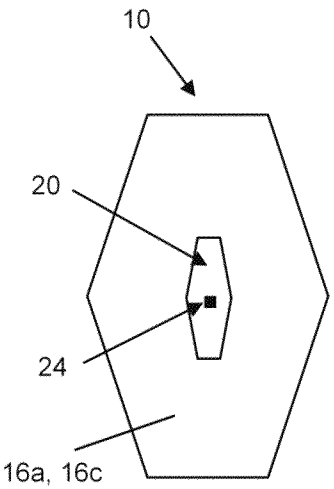
FIG. 6B shows an octahedral staple 10 comprising an octahedral cavity 20.
Figure 6C:
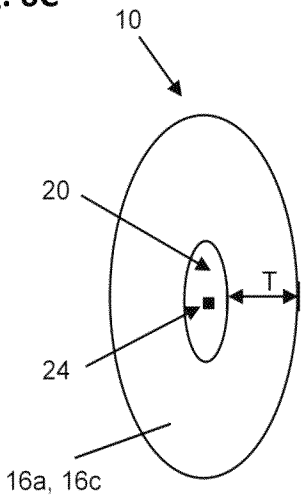
FIG. 6C shows an elliptic staple 10 comprising an elliptic cavity 20.
Figure 6D:
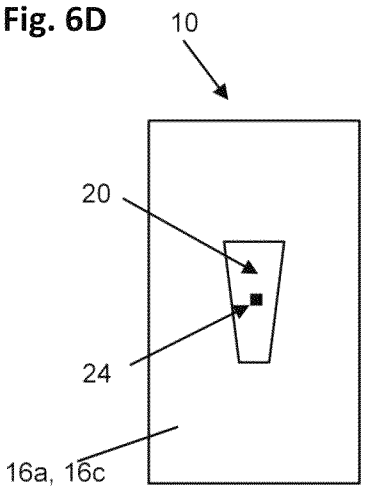
FIG. 6D shows a rectangular hexahedral staple 10 comprising a trapezoidal cavity 20.
Figure 6E:
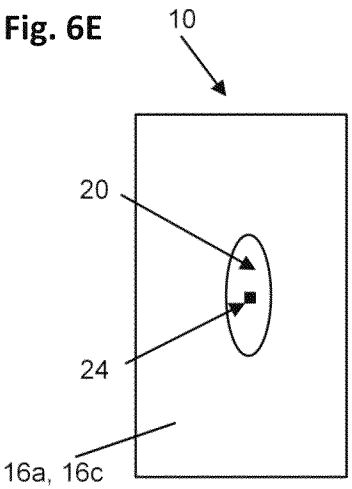
FIG. 6E shows a rectangular hexahedral staple 10 comprising an elliptic cavity 20.
Figure 6F:
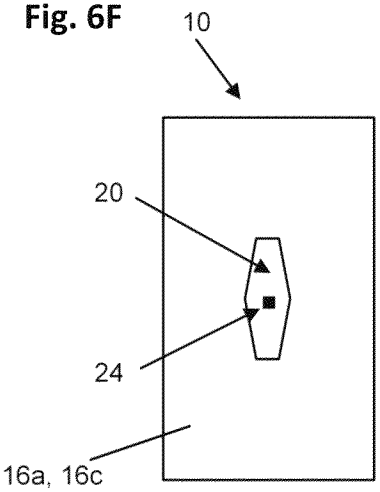
FIG. 6F shows a rectangular hexahedral staple 10 comprising an octahedral cavity 20.

FIGS. 6A to 6F show several examples of staples 10 having different shapes and/or comprising differently shape cavities, blind-holes and/or through-holes 20. A blind-hole or a through-hole is shown as an example for a cavity because the arrangement of the cavity inside the staple can be seen easier, if at least one opening is present at the outer surface of the staple. However closed cavities can be used as well as groove-holes. All features of the staple 10 disclosed in the embodiments shown before, whether described individually or in combination, are also applicable to the embodiment shown in FIG. 6. The same reference signs are used for the same features as used before. The blind-holes and/or through-holes 20 shown may be arranged in parallel to the longitudinal axis 24 of the staple 10. The staples 10 shown in FIGS. 6A to 6C comprise blind-holes and/or through-holes 20 which are shaped identically compared to the overall shape of the staple 10. FIG. 6A shows a trapezoidal staple 10 comprising a trapezoidal blind-hole and/or through-hole 20. FIG. 6B shows an octahedral staple 10 having an octahedral blind-hole and/or through-hole 20. FIG. 6C shows an elliptic staple 10 having an elliptic blind-hole and/or through-hole 20. FIGS. 6D to 6F show a rectangular staple 10 having differently shaped blind-holes and/or through-holes 20. FIG. 6D shows a rectangular staple 10 comprising a trapezoidal blind-hole and/or through-hole 20. FIG. 6E shows a rectangular staple 10 comprising an elliptic blind-hole and/or through-hole 20. FIG. 6F shows a rectangular staple 10 comprising an octahedral blind-hole and/or through-hole 20. Other combinations of shapes of cavities 20 and shapes of staples 10 are also possible.

Figure 7A:
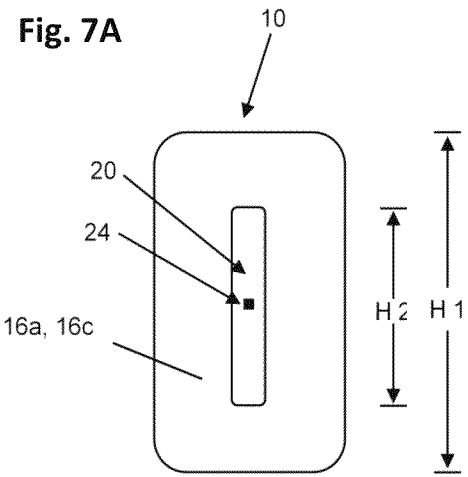
FIGS. 7A and B show long and small cavities 20.
Figure 7B:
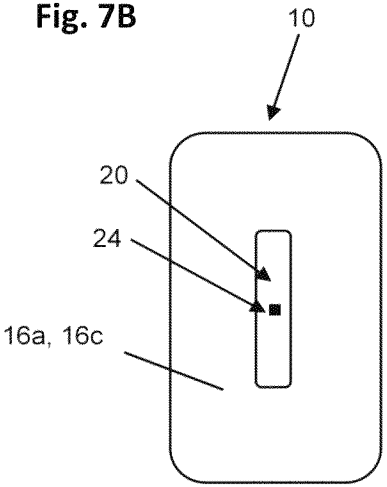
FIG. 7 shows several staples 10 comprising cavities 20 of several sizes.
FIG. 7C shows a short and wide cavity 20.
FIGS. 7D to F show several locations of cavities 20 inside the staple 10.
Figure 7C:
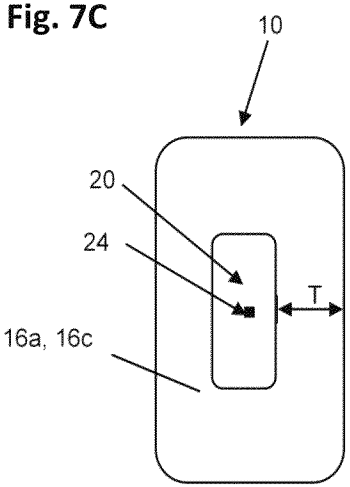

The cavities, blind-holes and/or through-holes 20 shown in FIGS. 1 to 6 are similar in size. The height H2 of the cavity, blind-hole, through-hole and/or groove-hole 20 may be in the range of about 30% to about 40% of the height H1 of the staple 10. However, other sizes of cavities, blind-holes, through-holes and/or groove-holes 20 are also enclosed. In the embodiments shown as an example in FIGS. 7A to 7C larger cavities, blind-holes and/or through-holes 20 are shown. The same reference signs are used for the same features as used before. For example, the height H2 of the cavity, blind-hole and/or through-hole 20 may be varied (FIGS. 7A, B). In addition or alternatively, the width of the cavity, blind-hole and/or through-hole may be varied so that the wall thickness T of the staple 10 may be varied accordingly. FIG. 7C shows an embodiment wherein the width of the cavity, blind-hole and/or through-hole 20 may be increased compared to the width shown in FIGS. 7A, B. All features of the staple 10 disclosed in the embodiments shown before, whether described individually or in combination, are also applicable to the embodiments shown in FIG. 7.

In addition or alternatively, the cavity, blind-hole, through-hole and/or groove-hole may be arranged in the center of the staple or the cavity, blind-hole and/or through-hole may be shifted to at least one side. In one embodiment, the cavity, blind-hole and/or through-hole may be arranged near to that side of the staple which shall be located at the bottom of the tuft hole. Such staples can be easily compressed in the area which shall be inserted into the tuft hole first. In another embodiment, the cavity, blind-hole and/or through-hole may be arranged near to that side of the staple which shall be located at the upper side of the bristle head. In another embodiment, the cavity, blind-hole and/or through-hole may be arranged nearly all over the height of the staple. The cavity, blind-hole and/or through-hole may be also shifted laterally inside the staple, but the wall thickness should not be less than about 0.01 mm.

Figure 7D:
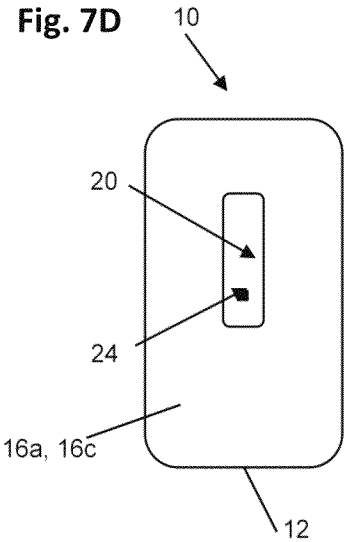
Figure 7E:
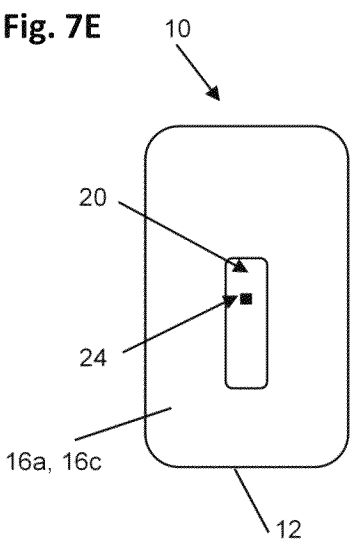
Figure 7F:
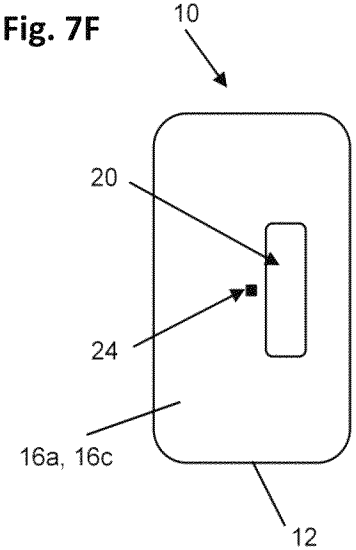
Figure 8A:
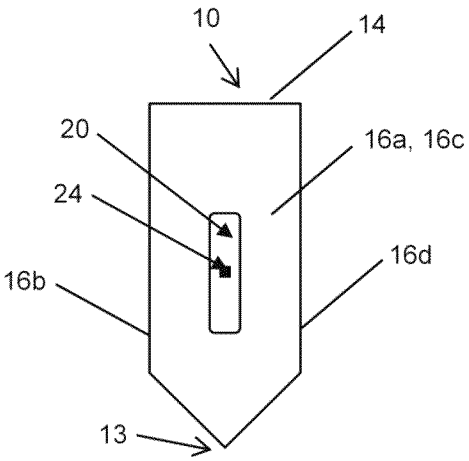
FIG. 8A shows a staple 10 which narrows symmetrically towards the base so that the first face 12 becomes an edge 13.
Figure 8B:
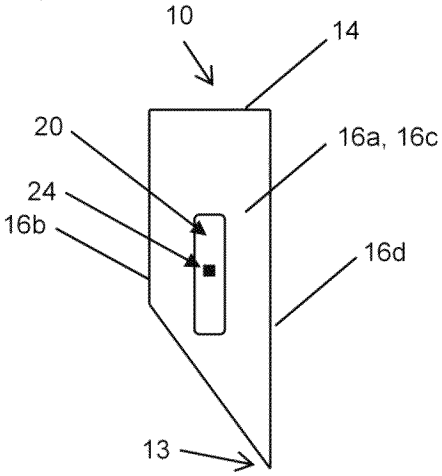
FIG. 8B shows a staple 10 which narrows asymmetrically towards the base so that an edge 13 is formed at the lateral side 16*d*.
Figure 8C:
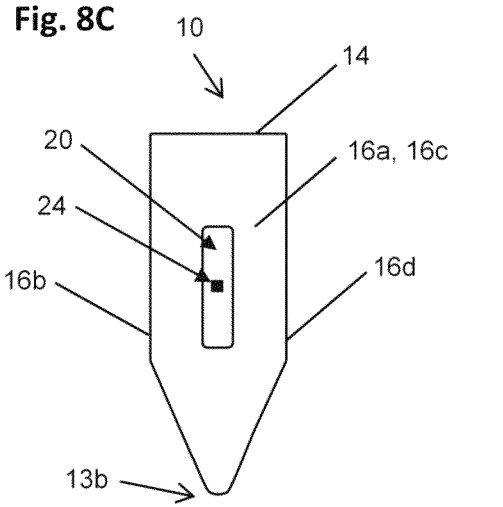
FIG. 8C shows a staple 10 which narrows incompletely towards the base so that the first face 12 becomes a smooth edge 13*b*.
Figure 8D:
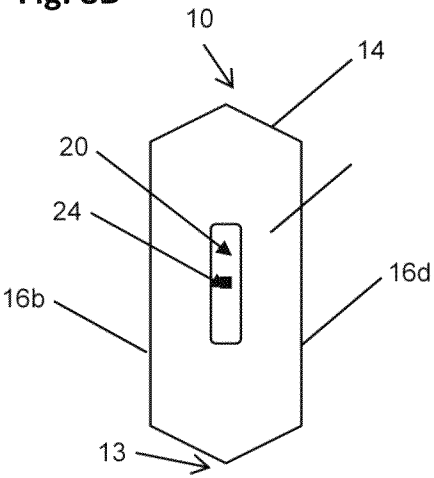
FIG. 8D shows a staple 10 which narrows symmetrically towards both ends.
Figure 8E:
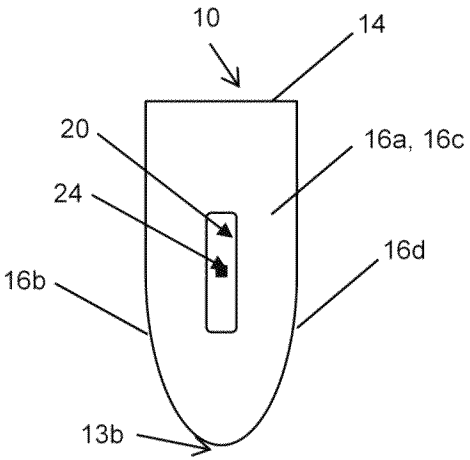
FIG. 8E shows a staple 10 which narrows over the total height of the staple 10.
Figure 9A:
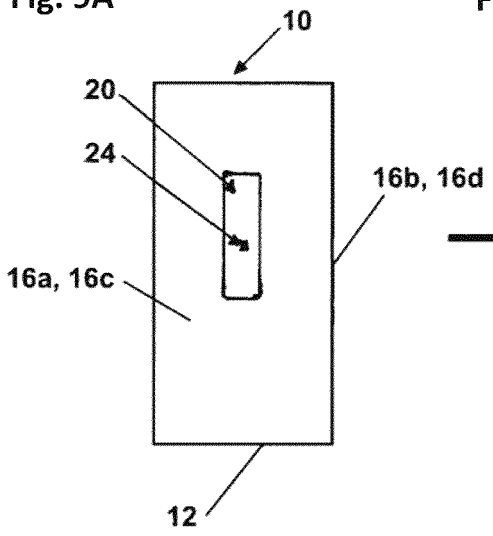
FIGS. 9A and B show a staple 10 being a rectangular cube.
Figure 9B:
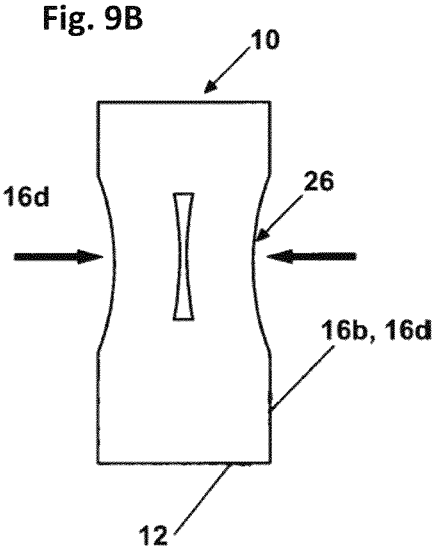
FIG. 9 shows the compression in one compression direction of the staple 10.
FIGS. 9C and D show a narrowed staple 10 being a rectangular cube.
Figure 9C:
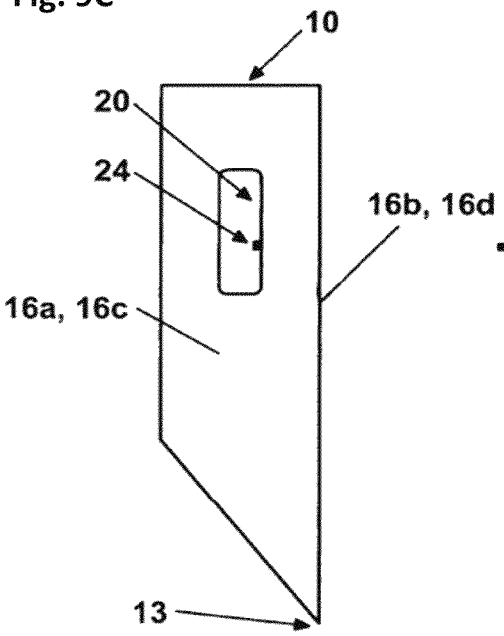
Figure 9D:
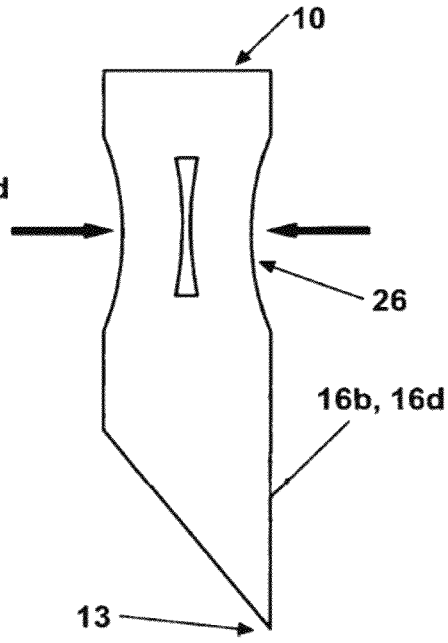
Figure 10A:
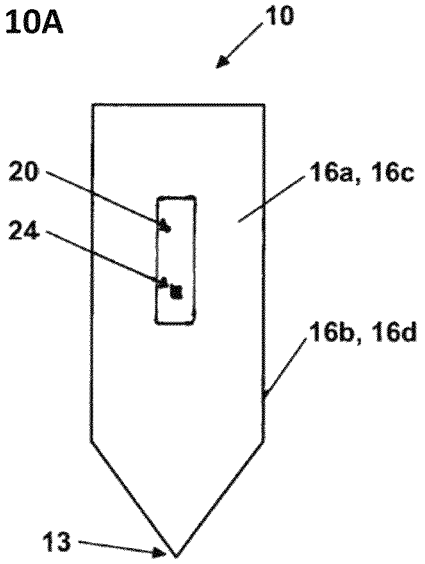
FIGS. 10A and B show a narrowed staple 10 being a rectangular cube.
Figure 10B:
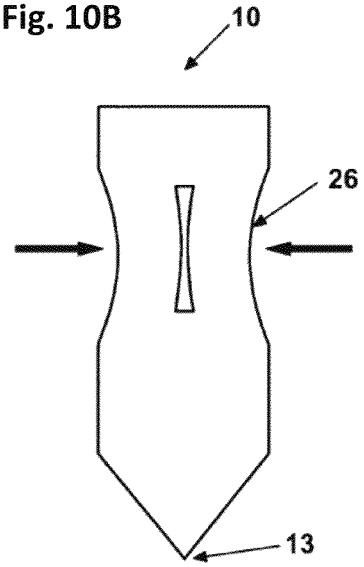
FIG. 10 shows the compression in one compression direction of further examples of the staple 10.
FIGS. 10C and D show a narrowed staple 10, being a rectangular cube, wherein narrowing is incomplete.
Figure 10C:
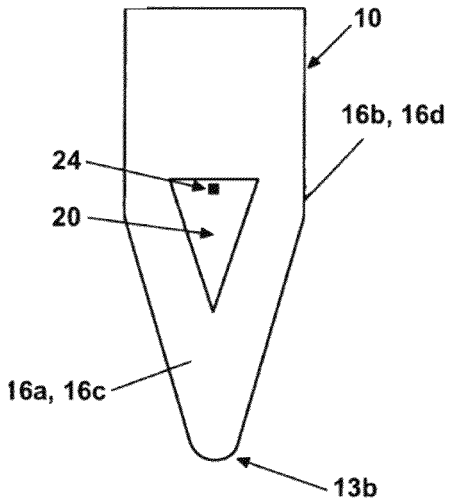
Figure 10D:
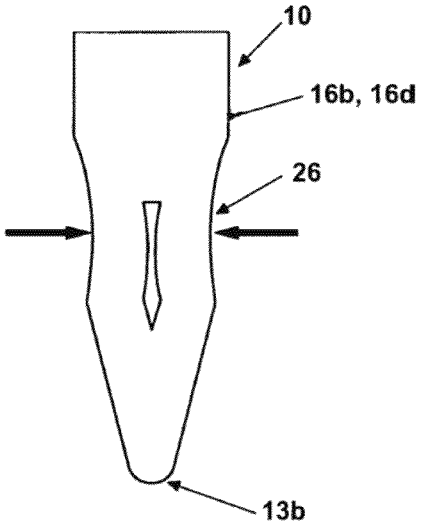

FIGS. 7D to E show examples in which the cavities 20 are not arranged in the center of the staple 10. In FIG. 7D the position of the cavity 20 inside the staple 10 may be shifted to the upper side 14 of the staple 10. FIG. 7E comprises a cavity 20 which may be arranged near to the lower side 12 of the staple 10 and the embodiment shown in FIG. 7F shows a cavity 20 which may be located near to one of the lateral faces 16*b*, 16*d*. A blind-hole or a through-hole is shown as an example.

In addition or alternatively, the staple as described herein may be narrowed at least towards one side. "Narrowing" means that the dimension of the staple decreases in one direction. For instance, if the staple is a rectangular prism one face is reduced to an edge. If the staple narrows from both lateral sides, the edge may be located in the middle of the staple. If the staple narrows only from one lateral side, the edge may be located at said lateral side from which the staple did not narrow. The resulting edge after narrowing may be sharp or smooth. Narrowing towards a smooth edge may reduce the risk of cutting the bent filaments during the stapling. Narrowing may start from any of the lateral faces, if the staple is a polyhedron. If cylindrical staples are narrowed the base and the top become an irregular shape. If the staple comprises a blind-hole, a through-hole and/or a groove-hole as the cavity narrowing may start at one or two of the lateral side faces which do not comprise an opening of the cavity. Narrowing may be continuous or non-continuous. Narrowing may be symmetrical or asymmetrical. Narrowing may be regular or irregular. Thereby the narrowing may occur over the total height of the staple. In another embodiment, the narrowing may start in a distance of about 5% to about 50%, in particular in a distance of about 5% to about 40% or in a distance of about 10% to about 30% or in a distance of about 15% to about 30% of the total height of the staple. In one embodiment, narrowing may be towards the first face which is adapted to be located at the bottom of the tuft hole. In addition or alternatively, narrowing may be towards the second face which is placed in the opening of the tuft hole at the upper side. Narrowing towards the face which is intended to be inserted first into the tuft-hole may simplify insertion of the staple.

FIG. 8 shows examples of staples 10 which narrow towards one side, in particular the first face 12. A blind-hole or a through-hole is shown as an example for a cavity because the arrangement of the cavity inside the staple can be seen easier, if at least one opening is present at the outer surface of the staple. However closed cavities or groove-holes can be used as well. All features of the staple 10 disclosed in the embodiments shown before, whether described individually or in combination, are also applicable to the embodiment shown in FIG. 8. The same reference signs are used for the same features as used before. FIG. 8A shows a side view of the staple 10 which narrows equally from both lateral sides 16*b*, 16*d* which do not comprise an opening of the blind-hole and/or the through-hole 20. Thus, the first face 12 may be reduced to a sharp edge 13 which is located in the middle of the staple 10. The narrowing starts at about 20% of the total height of the staple 10. FIG. 8B shows a side view of staple 10 which narrows equally from one lateral side 16*b*. Thus, the first face 12 may be reduced to a sharp edge 13 which may be located at the lateral face 16*d*. The narrowing starts at about 40% of the total height of the staple 10. FIG. 8C shows a side view of the staple 10 which narrows equally from both lateral sides 16*b*, 16*d* which do not comprise an opening of the blind-hole and/or the through-hole 20. Narrowing may be stopped so that the first face 12 may be reduced to a smooth edge 13*b* which is located in the middle of the staple 10. Narrowing starts at about 30% of the total height of the staple 10.

In addition or alternatively, the surface of the staple may be structured by one or more recesses. "Recesses" as used herein shall mean any depression or groove which does not penetrate the walls of the staple. Thus, the cavity of the staple and the recesses which may be arranged on the outside of the staple may be not combined. In another embodiment, recesses and an opening of a blind-hole and/or a through-hole may be arranged at the same side of a staple.

Shape and geometry of the staple as described herein are feasible via extrusion technology. The staples as disclosed herein may consist of a stimulus-responsive material. A "stimulus-responsive material" as used herein shall mean that after a stimulus, for instance a punching force, the material responses by an alteration of the material shape and geometry. Therefore several material properties, such as the tensile modulus of elasticity, the hardness, the impact strength, the impact resistance, the notched impact strength and/or the water uptake may influence the production of said staples. As far as the tensile modulus of elasticity and the hardness are concerned, at least one of the values of these properties of the material used for the staple as disclosed herein shall be larger than the corresponding value for the base material. The "base material" as used herein shall be the material into which the staple shall be inserted. This may be for instance the brush head material. These properties assure that the brush head material can be deformed through the insertion of the staple. At the same time, the staple itself shall be deformed only slightly, leading to the formation of grooves or dents on the outside of the staple. Thus, suitable materials for the staples as described herein may be materials having a higher tensile modulus of elasticity and/or having a higher hardness than the material(s) from which the tuft hole shall be produced. Suitable materials may be rigid and non corrosive synthetic or natural materials. "Rigid" material is a material having a structure that does not bend or flex under an applied force. It is defined as the opposite of flexibility. If a rigid structure cannot flex it means that there is no continuous motion of the structure that preserves the shape or pattern. In one embodiment, the staple may be extruded from polymeric materials.

The impact strength and the impact resistance as well as the notched impact strength are properties responsible for the brittleness of the staples. These parameters have to be high enough to guarantee that the staple is not breaking into pieces through the punching mechanism and insertion procedures. However, that means that the brittleness is reduced at the same time. Furthermore such properties assure that the cutting of extruded fiber material leads to intact staples. Otherwise the staples would break into many pieces during the cutting process.

The water uptake of the staple material should not be too high as this would possibly lead to swelling and shrinking of the staples. This could result in cavity widening of the base material and possible loss of the staple after stapling. Thus, the staple as disclosed herein may be extruded from plastic materials. Suitable materials for the staples comprise a similar or different melting point than the brush head material, examples are polyolefin, styrene polymer, vinyl polymer, acrylic polymer, polyamide, polyester, polyether, polyimide, LCP polyurethane, polyetherketone or a blend thereof. In one embodiment, fiber and/or powder filled polymeric materials joinable by material engagement can be used to extrude the staples as described herein.

FIG. 9 and FIG. 10 show the stimulus-responsive effect during punching of the staples 10 as described herein. Four different embodiments of staples 10 are shown as examples. All features of the staples 10 disclosed in the embodiments shown before, which are described individually or in combination, are also applicable to the staples 10 shown in the embodiments of FIGS. 9 and 10. The same reference signs are used for the same features as used in embodiments shown before. The staple 10 shown in FIGS. 9A and B may comprise a flat first face 12. Alternatively, one staple 10 is shown that narrows asymmetrically towards one lateral side face 16*b*, 16*d* so that a sharp edge 13 is formed (FIGS. 9C, 9D). Another staple 10 is shown that narrows symmetrically towards the first face 12 so that a sharp edge 13 is formed (FIGS. 10A, 10B). In addition or alternatively, another embodiment is shown in FIGS. 10C and 10D. The staple 10 narrows symmetrically towards the first face 12 to form a smooth edge 13*b*. In FIGS. 10C, 10D the staple narrows over a larger part of its volume compared to the embodiment shown in FIGS. 10A, 10B.

FIGS. 9A, 9C, 10A and 10C show the staple 10 having a blind-hole and/or a through-hole 20 without the application of any external forces. The same reference signs are used for the same features as used in embodiments shown before. If the lateral faces 16*b*, 16*d* which do not comprise an opening of the blind-hole and/or the through-hole 20 are compressed, the cavity 20 decreases (FIGS. 9B, 9D, 10B and 10D). Thereby the lateral side faces 16*b*, 16*d* are deformed, building a concave shape and forming a recess and/or dent 26 on the surface. If the blind-hole and/or through-hole 20 is arranged near to the first face 12 or the edge 13, 13*b*, the dimension of the staple 10 is decreased in the area which is inserted first into the tuft hole. Thus, insertion becomes easier. If the blind-hole and/or through-hole 20 is located in the upper part of the staple 10, the clamping effect to the bent filaments is increased. Deformation of the staple 10 occurs during insertion into the receptacle.

Figure 11:
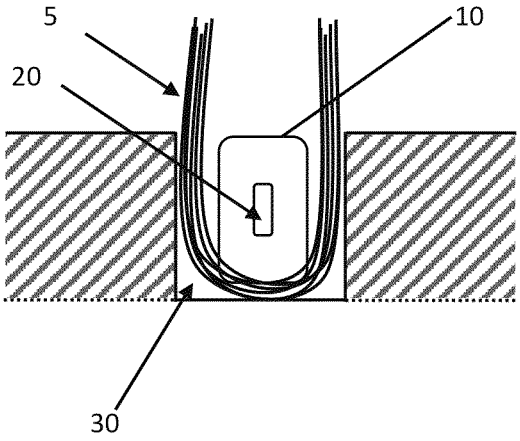
FIG. 11 shows a staple 10 being stapled into a tuft hole 30 so that filaments 5 are stapled into said tuft hole 30.

FIG. 11 shows a magnification of a tuft hole 30 in which a plurality of filaments 5 are inserted via a staple 10 as described herein. All features of the staple 10 disclosed in the embodiments shown before whether described individually or in combination, are also applicable to the embodiment shown in FIG. 11.

In accordance with another aspect, a method shall be provided to produce staples as proposed for stapling filament tufts into a tuft hole. The method comprises the steps of producing a strand of staples using extrusion technology and cutting the strand into a plurality of staples of a predefined length. The staples produced according to said method comprise at least one cavity and/or one or more recesses at the outer surface. In one embodiment, the at least one cavity may be a cavity, a blind-hole, a through-hole and/or a groove-hole. In another embodiment, the cavity, blind-hole, through-hole and/or groove-hole may be located along and/or in parallel to the longitudinal axis, and/or perpendicularly to the longitudinal axis and/or inclined to the longitudinal axis of the staple. Recesses may be located on the outer surface of the cavity. In one embodiment, recesses may be located at the lateral side faces of the staple. In one embodiment, the staple comprises at least one cavity, blind-hole, through-hole and/or groove-hole and at least one recess. In another embodiment, the at least one recess may be located on the lateral side faces which do not comprise an opening of the cavity, blind-hole and/or through-hole. In addition or alternatively, the one or more recesses may be located on the side faces of the staple which comprise an opening of the blind-hole and/or through-hole. Total length of the staple strand may be in some cases limited by extrusion technology, wherein shorter strands can be handled easier. The desired length of a staple which is cut from the strand can be varied according to the requirements such as the dimension of the tuft hole for which the staple is intended.

Figure 12:
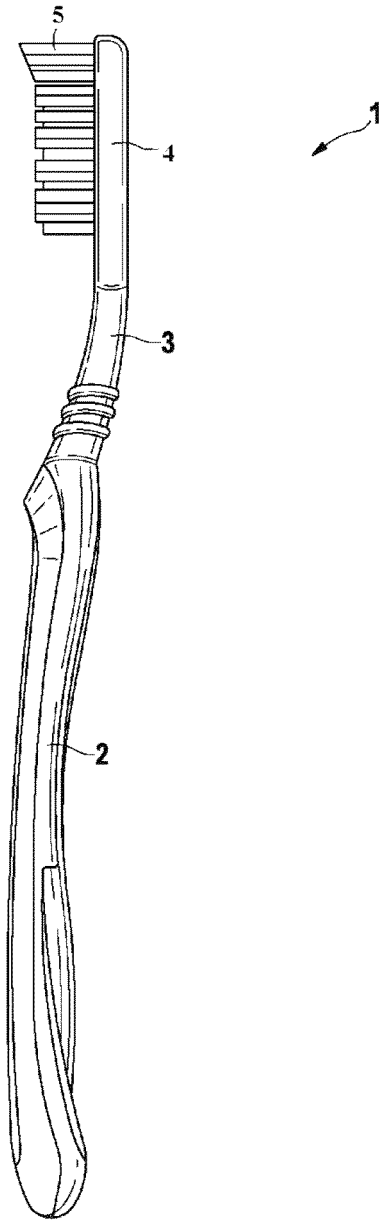
FIG. 12 shows a toothbrush 1 having at least one filament 5 which is stapled with a staple 10.

In accordance with another aspect, an oral cleaning implement such as a toothbrush or a disposable cleaning head is disclosed herein. Said oral cleaning implement may comprise a head portion having one or more cleaning elements a shaft portion to handle the toothbrush, a neck portion connecting the brush head portion and the shaft portion. In one embodiment, the cleaning elements comprise at least one filament tuft comprising a plurality of filaments and said filament tuft is stapled into a tuft hole by a staple as disclosed herein. A toothbrush as an example for such an oral care implement is shown in FIG. 12. A toothbrush 1 comprises a brush head portion 4, a shaft portion 2 to handle the toothbrush 1 and a neck portion 3 connecting the brush head portion 4 and the shaft portion 2. One or more cleaning elements 5 are attached to the brush head portion 4. In one embodiment, the cleaning elements 5 are filament tufts which are bent into a tuft hole. To staple the filament tufts into the tuft holes, staples 10 as described herein are used. All features of the staples 10 disclosed in the embodiments shown before, which are described individually or in combination, are also applicable to the staples 10 used in the embodiment shown in FIG. 12.

In accordance with another aspect, a method for stapling filaments in a brush head portion of an oral care implement, such as a toothbrush is disclosed. Said method comprises the steps of bending at least one filament around a staple as disclosed herein, compressing the staple in at least one compression direction by punching the lateral faces and driving the compressed staple together with the bent filament tuft into the tuft hole. Due to the pressure applied onto the side faces of the staple the cavity is compressed and the volume of the staple is reduced at least in the compression direction. Thus, the staple becomes smaller and it is easier to insert the staple into the tuft hole. After the pressure is released the staple reshapes at least partially due to its elastic properties. Thereby the staple is stapled into the tuft hole. In one embodiment, the volume of the staple is reduced during compression by at least about 1%. In another embodiment, the volume of the staple is reduced during compression by at least about 2%. In another embodiment, the volume of the staple is reduced during compression by at least about 5%. In another embodiment, the volume of the staple is reduced during compression by at least about 10%. In a further aspect, the brush head and the staple can be further associated one with the other via welding technology.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An oral cleaning implement comprising:

a head portion having a longitudinal axis and comprising one or more cleaning elements, wherein the one or more cleaning elements include at least one filament tuft having a plurality of filaments and wherein the at least one filament tuft is fastened into a tuft hole with an elongated staple having a longitudinal axis that is substantially transverse relative to the longitudinal axis of the head portion, wherein the staple includes a deformable cavity comprising a hole extending substantially parallel to the longitudinal axis of the staple and having at least one opening in the staple, wherein the deformable cavity causes the staple to be compressible crosswise relative to the longitudinal axis of the staple, and wherein the at least one filament tuft is bent around the staple in a U-shape.

2. The oral cleaning implement according to claim 1, wherein the cavity of the staple is a blind hole having one opening on a surface area of the staple.

3. The oral cleaning implement according to claim 1, wherein the deformable cavity is a through-hole having two openings arranged substantially opposite to each other.

4. The oral cleaning implement according to claim 1, wherein the staple and the cavity each comprise a height (H1, H2) being perpendicular to the longitudinal axis of the staple and wherein the height (H2) of the cavity is in the range of from about 10% to about 60% of the height (H1) of the staple (10).

5. The oral cleaning implement according to claim 1, wherein the opening of the cavity on one surface of the staple includes from about 5% to about 50% of the surface of the staple.

6. The oral cleaning implement according to claim 1, wherein the staple is narrowing at least towards one side.

7. The oral cleaning implement according to claim 1, wherein the shape of the staple includes rounded edges.

8. The oral cleaning implement according to claim 1, wherein a surface of the staple is structured by one or more recesses.

9. The oral cleaning implement according to claim 1, wherein the staple includes a polymeric material or a mixture of polymeric materials.

10. The oral cleaning implement according to claim 9, wherein the polymeric material is selected from the group consisting of a polyolefin, a styrene polymer, a vinyl polymer, an acrylic polymer, a polyamide, a polyester, a polyether, a polyimide, a LCP polyurethane, a polyetherketone and mixtures thereof.

11. The oral cleaning implement according claim 1, wherein the staple includes at least a material having a higher tensile modulus of elasticity and/or having a higher hardness than the material of the tuft hole in which the staple is arranged.

12. The oral cleaning implement according to claim 1, wherein the staple is extruded.

* * * * *